US010639720B2

(12) United States Patent
Kuniyoshi

(10) Patent No.: US 10,639,720 B2
(45) Date of Patent: May 5, 2020

(54) DIFFUSION TREATMENT DEVICE AND METHOD FOR MANUFACTURING R-T-B SYSTEM SINTERED MAGNET USING SAME

(71) Applicant: HITACHI METALS, LTD., Minato-ku, Tokyo (JP)

(72) Inventor: Futoshi Kuniyoshi, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 292 days.

(21) Appl. No.: 15/754,647

(22) PCT Filed: Aug. 19, 2016

(86) PCT No.: PCT/JP2016/074242
§ 371 (c)(1),
(2) Date: Feb. 23, 2018

(87) PCT Pub. No.: WO2017/033861
PCT Pub. Date: Mar. 2, 2017

(65) Prior Publication Data

US 2018/0236554 A1 Aug. 23, 2018

(30) Foreign Application Priority Data

Aug. 24, 2015 (JP) ..... 2015-164775

(51) Int. Cl.
*B22F 3/24* (2006.01)
*F27B 7/34* (2006.01)
(Continued)

(52) U.S. Cl.
CPC ..... *B22F 3/24* (2013.01); *C22C 19/07* (2013.01); *C22C 28/00* (2013.01); *C22C 38/00* (2013.01);
(Continued)

(58) Field of Classification Search
None
See application file for complete search history.

(56) References Cited

U.S. PATENT DOCUMENTS 4,362,501 A * 12/1982 Welter ..... C21D 9/0062 373/109
6,735,983 B1 * 5/2004 Taru ..... C03B 37/0253 65/377
(Continued)

FOREIGN PATENT DOCUMENTS

CN 104040655 9/2014
JP 2000-154034 6/2000
(Continued)

OTHER PUBLICATIONS

International Search Report for PCT/JP2016/074242 dated Nov. 1, 2016.

*Primary Examiner* — Xiaowei Su
(74) *Attorney, Agent, or Firm* — Nixon Peabody LLP; Jeffrey L. Costellia

(57) ABSTRACT

A diffusion treatment device includes: a treatment container including a cylindrical main body and first and second lids, the cylindrical main body having a treatment space which is capable of receiving sintered magnet pieces and RH diffusion sources, the first and second lids being capable of hermetically sealing first and second openings, respectively, at opposite ends of the cylindrical main body; a conveyor for conveying the treatment container by a predetermined distance in an x-axis direction while a longitudinal direction of the treatment container is located in a y-axis direction in a rectangular coordinate system xyz; a heating unit including a lower heating section provided under the treatment container and an upper heating section provided above the treatment container, and a first rotating unit for rotating the treatment container around a y-axis while the longitudinal
(Continued)

direction of the treatment container is located in the y-axis direction.

19 Claims, 3 Drawing Sheets

(51) Int. Cl.

| | |
|---|---|
| ***F27B 7/38*** | (2006.01) |
| ***C22C 28/00*** | (2006.01) |
| ***C22C 38/00*** | (2006.01) |
| ***H01F 41/02*** | (2006.01) |
| ***C22C 38/10*** | (2006.01) |
| ***C22C 38/32*** | (2006.01) |
| ***C22C 19/07*** | (2006.01) |
| ***H01F 1/057*** | (2006.01) |
| ***H01F 1/08*** | (2006.01) |
| ***H01F 1/053*** | (2006.01) |
| *C22C 33/02* | (2006.01) |
| *F27D 3/12* | (2006.01) |

(52) U.S. Cl.

CPC ..... *C22C 38/005* (2013.01); *C22C 38/10* (2013.01); *C22C 38/32* (2013.01); *H01F 1/057* (2013.01); *H01F 1/0536* (2013.01); *H01F 1/08* (2013.01); *H01F 41/02* (2013.01); *H01F 41/0293* (2013.01); *B22F 2999/00* (2013.01); *C22C 33/02* (2013.01); *F27D 3/12* (2013.01); *H01F 1/0577* (2013.01)

(56) References Cited

U.S. PATENT DOCUMENTS

| | | | | |
|---|---|---|---|---|
| 2008/0286595 | A1 | 11/2008 | Yoshimura et al. | |
| 2010/0012035 | A1 | 1/2010 | Nagata et al. | |
| 2012/0112863 | A1* | 5/2012 | Kuniyoshi ..... | B22F 3/24 335/302 |
| 2013/0112141 | A1 | 5/2013 | Kuniyoshi et al. | |
| 2014/0329007 | A1 | 11/2014 | Obata | |
| 2014/0375404 | A1 | 12/2014 | Kuniyoshi et al. | |

FOREIGN PATENT DOCUMENTS

| | | |
|---|---|---|
| JP | 2011-129648 | 6/2011 |
| JP | 2012-204696 | 10/2012 |
| JP | 2014-72259 | 4/2014 |
| JP | 2016-189398 | 11/2016 |
| WO | WO-2007-102391 | 9/2007 |
| WO | WO-2008-032668 | 3/2008 |
| WO | WO-2011-007758 | 1/2011 |
| WO | WO-2012-008416 | 1/2012 |
| WO | WO-2013-108830 | 7/2013 |
| WO | WO-2017-018291 | 2/2017 |

* cited by examiner

DIFFUSION TREATMENT DEVICE AND METHOD FOR MANUFACTURING R-T-B SYSTEM SINTERED MAGNET USING SAME

TECHNICAL FIELD

The present invention relates to a diffusion treatment device and a method for manufacturing an R-T-B sintered magnet using the diffusion treatment device, and particularly to a method for manufacturing an R-T-B sintered magnet in which a heavy rare earth element RH, such as Dy, is supplied to a surface of a sintered magnet piece of a R—Fe—B alloy, and the heavy rare earth element RH is diffused into the sintered magnet piece.

BACKGROUND ART

R-T-B sintered magnets whose primary phase is a $Nd_2Fe_{14}B$ compound have been known as the best performance magnets among permanent magnets, and have been used in various motors, including voice coil motors (VCM) of hard disk drives and motors incorporated in hybrid vehicles, home electronics, etc. Since some or all of Nd may be replaced by a different rare earth element R and some of Fe may be replaced by a different transition metal element, the $Nd_2Fe_{14}B$ compound will also be referred to as "$R_2T_{14}B$ compound". Note that some of B can be replaced by C (carbon).

Since the R-T-B sintered magnet has decreased coercivity at a higher temperature, irreversible degaussing occurs such that the coercivity decreases when exposed to a high temperature. To avoid the irreversible degaussing, maintenance of high coercivity is required even at high temperatures when the magnet is used for motors or the like. This cannot be achieved without increasing the coercivity at the normal temperature or decreasing the change in coercivity till a demanded temperature is reached.

It has been known that when Nd, which is the light rare earth element RL in a $R_2T_{14}B$ compound phase, is replaced by a heavy rare earth element RH (mainly, Dy, Tb), the coercivity increases. Adding a large amount of heavy rare earth element RH to a source material alloy for the R-T-B sintered magnet has been considered to be effective in achieving high coercivity at high temperatures. However, when the light rare earth element RL (Nd, Pr) is replaced by a heavy rare earth element RH in the R-T-B sintered magnet, the residual magnetic flux density disadvantageously decreases although the coercivity improves. Also, the heavy rare earth element RH is a rare resource, and therefore, reducing the consumption of that element has been demanded.

In view of the above, in recent years, improving the coercivity of the R-T-B sintered magnet with a smaller amount of heavy rare earth element RH such that the residual magnetic flux density would not decrease has been studied. The present applicant already disclosed in Patent Document 1 that a heavy rare earth element RH, such as Dy, is supplied to a surface of a sintered magnet piece of a R—Fe—B alloy, and the heavy rare earth element RH is diffused into the sintered magnet piece (hereinafter, referred to as "depositional diffusion").

According to the method of Patent Document 1, an R-T-B sintered magnet piece and an RH bulk of a heavy rare earth element RH need to be arranged in a treatment chamber such that they are spaced away from each other. Therefore, for example, the process for the arrangement is disadvantageously laborious. Further, since the supply of Dy or Tb is realized by sublimation, there is a probability that a long time is required to increase the amount of diffusion into the R-T-B sintered magnet piece and achieve higher coercivity.

In view of the above, the present applicant disclosed, in Patent Document 2, a manufacturing method of an R-T-B sintered magnet, including the step of providing R-T-B sintered magnet pieces, the step of providing RH diffusion sources which are made of a metal or alloy of a heavy rare earth element RH (at least one of Dy and Tb), the step of loading the R-T-B sintered magnet pieces and the RH diffusion sources into a treatment chamber such that the R-T-B sintered magnet pieces and the RH diffusion sources are relatively movable and can be in the vicinity of each other or in contact with each other, and the RH diffusion step of performing a heat treatment at a temperature not less than 500° C. and not more than 850° C. for not less than 10 minutes while continuously or intermittently moving the R-T-B sintered magnet pieces and the RH diffusion sources in the treatment chamber.

According to the method of Patent Document 2, the RH diffusion sources are in the vicinity of or in contact with the R-T-B sintered magnet pieces even at the temperature of not less than 500° C. and not more than 850° C. Therefore, the heavy rare earth element RH is supplied from the RH diffusion sources and can be diffused into the R-T-B sintered magnet piece through the grain boundary.

The present applicant also disclosed, in Patent Document 3, a manufacturing method of an R-T-B sintered magnet, including the step of providing an R-T-B sintered magnet pieces in which the amount of R, which is defined by the content of a rare earth element, is not less than 31 mass % and not more than 37 mass %, the step of providing RH diffusion sources which include a heavy rare earth element RH (at least one of Dy and Tb) and Fe in the proportion of not less than 30 mass % and not more than 80 mass %, the step of loading the sintered magnet pieces and the RH diffusion sources into a treatment chamber such that the sintered magnet pieces and the RH diffusion sources are relatively movable and can be in the vicinity of each other or in contact with each other, and the RH diffusion step of heating the sintered magnet pieces and the RH diffusion sources to a treatment temperature of not less than 700° C. and not more than 1000° C. while continuously or intermittently moving the sintered magnet pieces and the RH diffusion sources in the treatment chamber.

According to the manufacturing method disclosed in Patent Document 3, the heavy rare earth element RH can be diffused into the R-T-B sintered magnet piece (the magnet before execution of the RH diffusion step) within a short time period, such that $H_{cJ}$ can be improved without decreasing $B_r$. Further, even though the RH diffusion step is carried out in a wide temperature range of not less than 700° C. and not more than 1000° C., the R-T-B sintered magnet pieces and the RH diffusion sources would not cause fusion, and the heavy rare earth element RH can be diffused into the R-T-B sintered magnet piece.

The entire contents of Patent Documents 2 and 3 are incorporated by reference in this specification.

CITATION LIST

Patent Literature

Patent Document 1: WO 2007/102391
Patent Document 2: WO 2011/007758
Patent Document 3: WO 2013/108830

SUMMARY OF INVENTION

Technical Problem

However, in manufacturing devices disclosed in Patent Documents 2 and 3, disadvantageously, a subsequent diffusion treatment cannot be performed before the sintered magnet pieces, the RH diffusion sources, and optional agitation assisting members (the agitation assisting members are not necessarily indispensable in the diffusion treatment but can be optionally used) are thoroughly removed from the treatment chamber after a previous diffusion treatment. In other words, the step of performing the diffusion treatment and the step of removing the sintered magnet pieces, the RH diffusion sources and the agitation assisting members from the treatment container cannot be simultaneously carried out. This is because there is a probability that newly-loaded sintered magnet pieces for the subsequent diffusion treatment are mixed in the sintered magnet pieces which have undergone the previous diffusion treatment. When, particularly in mass production, the length of the treatment chamber (the length from loading to takeout) is increased for the purpose of increasing the throughput, a long time is required for the takeout, so that the productivity deteriorates. Further, in some cases, a cooling chamber is provided subsequent to the treatment chamber for the purpose of efficiently collecting the sintered magnet pieces after the diffusion treatment. Also in this case, in order to prevent newly-loaded sintered magnet pieces provided for the subsequent diffusion treatment from being mixed in, the previously-treated sintered magnet pieces, the RH diffusion sources and the agitation assisting members need to be thoroughly removed from the cooling chamber before a subsequent diffusion treatment. This necessity causes deterioration in productivity.

To reduce the time required for takeout of the sintered magnet pieces, the RH diffusion sources and the agitation assisting members, decreasing the length of the treatment chamber may be a possible solution. However, in this case, the throughput decreases, and the mass production efficiency accordingly decreases. To prevent this, increasing the height of the treatment chamber (increasing the diameter of the cylindrical treatment chamber) so as to increase the throughput may be a possible solution. However, when the diameter of the treatment chamber was increased, many chips were formed in the sintered magnet pieces in some cases. This seems to be because the distance traveled by the sintered magnet pieces when the cylindrical treatment chamber is rotated increases in accordance with the increase of the diameter, and accordingly, the sintered magnet pieces hit one another with greater impact. Particularly, sintered magnet pieces for use in motors for the motive power source of automobiles and motors for industrial devices, the demands for which have been increasing in recent years, have a small and elongated shape (e.g., 30 mm in length×10 mm in width×5 mm in thickness). Particularly when such sintered magnet pieces are treated, chips are likely to be formed.

The present invention was conceived for the purpose of solving the above-described problems. One of the major objects of the present invention is to provide a diffusion treatment device which is capable of performing a diffusion treatment with higher mass production efficiency than the above-described conventional manufacturing devices while formation of chips is reduced, and a method for manufacturing an R-T-B sintered magnet with the use of the diffusion treatment device.

Solution to Problem

A diffusion treatment device of an embodiment of the present invention includes: a treatment container including a cylindrical main body and a first lid and a second lid, the cylindrical main body having a treatment space which is capable of receiving a plurality of R-T-B sintered magnet pieces and diffusion sources, the first lid and the second lid being capable of hermetically sealing a first opening and a second opening, respectively, at opposite ends of the cylindrical main body; a conveyor for conveying the treatment container by a predetermined distance in an x-axis direction while a longitudinal direction of the treatment container is located in a y-axis direction in a rectangular coordinate system xyz where a z-axis direction is a vertical direction; a heating unit including a lower heating section provided under the treatment container and an upper heating section provided above the treatment container, at least one of the lower heating section and the upper heating section being movable in the z-axis direction and being arrangeable so as to surround at least a central part of the treatment container, and a first rotating unit for rotating the treatment container around a y-axis while the longitudinal direction of the treatment container is located in the y-axis direction and the treatment container is surrounded by the lower heating section and the upper heating section. At least one of the first opening and the second opening may be hermetically sealed by the detachable first or second lid. One of the first lid and the second lid may be integrated with the main body.

In one embodiment, the lower heating section and the upper heating section are each movable in the z-axis direction.

In one embodiment, the treatment container further includes a first flange and a second flange at opposite ends in the longitudinal direction, and when the first lid is secured to the first flange and the second lid is secured to the second flange, the first opening and the second opening are respectively hermetically sealed. One of the first flange and the second flange may be integrated with the main body together with the first or second lid.

In one embodiment, the first rotating unit includes a first wheel pair which is in contact with at least one of the first flange and the first lid and a second wheel pair which is in contact with at least one of the second flange and the second lid, and the first wheel pair and the second wheel pair are each arranged along the x-axis direction and each include two wheels rotatable around the y-axis.

In one embodiment, the treatment container is detached from the conveyor while the first wheel pair and the second wheel pair support the treatment container.

In one embodiment, the two wheels of each of the first wheel pair and the second wheel pair have a variable rotation speed and/or are reversely rotatable.

In one embodiment, the diffusion treatment device further includes a connecting portion connected with either of the first lid or the second lid.

In one embodiment, the diffusion treatment device further includes a safety valve connected with the other of the first lid or the second lid.

In one embodiment, the diffusion treatment device further includes a first controller for outputting a signal for controlling at least one of movement of the treatment container in the x-axis direction, movement of the lower heating section and the upper heating section in the z-axis direction, and rotation of the first rotating unit.

In one embodiment, the diffusion treatment device further includes a second controller for outputting a signal for controlling the heating unit.

In one embodiment, the diffusion treatment device further includes a cooling unit subsequent to the heating unit, wherein the cooling unit includes a lower cooling section provided under the treatment container and an upper cooling section provided above the treatment container, at least one of the lower cooling section and the upper cooling section being movable in the z-axis direction and being arrangeable so as to surround at least a central part of the treatment container.

In one embodiment, the lower cooling section and the upper cooling section are each movable in the z-axis direction.

In one embodiment, the diffusion treatment device further includes a second rotating unit for rotating the treatment container around the y-axis while the longitudinal direction of the treatment container is located in the y-axis direction and the treatment container is surrounded by the lower cooling section and the upper cooling section.

In one embodiment, at least one of the lower cooling section and the upper cooling section includes at least one of an air inlet and a spray nozzle for water.

In one embodiment, the diffusion treatment device further includes a third controller for outputting a signal for controlling at least one of movement of the treatment container in the x-axis direction, movement of the lower cooling section and the upper cooling section in the z-axis direction, and rotation of the second rotating unit.

In one embodiment, the diffusion treatment device further includes a fourth controller for outputting a signal for controlling the cooling unit.

In one embodiment, the diffusion treatment device further includes a preheating unit prior to the heating unit, wherein the preheating unit includes a lower preheating section provided under the treatment container and an upper preheating section provided above the treatment container, at least one of the lower preheating section and the upper preheating section being movable in the z-axis direction and being arrangeable so as to surround at least a central part of the treatment container.

In one embodiment, the lower preheating section and the upper preheating section are each movable in the z-axis direction.

In one embodiment, the diffusion treatment device further includes a work loading unit prior to the heating unit, wherein the loading unit is capable of inclining the treatment container in a yz plane while the longitudinal direction of the treatment container is located in the y-axis direction.

In one embodiment, the diffusion treatment device further includes a supporting mechanism which is capable of adjusting a horizontality of an entirety of the diffusion treatment device.

In one embodiment, the treatment container includes a first heat insulator provided on the first opening side of the treatment space and a second heat insulator provided on the second opening side of the treatment space.

In one embodiment, the first heat insulator and the second heat insulator include a heat insulation fiber.

An R-T-B sintered magnet manufacturing method of an embodiment of the present invention includes: (a) providing R-T-B sintered magnet pieces in which an amount of R, which is defined by a content of a rare earth element, is not less than 29 mass % and not more than 40 mass %; (b) providing diffusion sources; (c) loading at least the sintered magnet pieces and the diffusion sources into the treatment space of the diffusion treatment device as set forth in any of the above paragraphs; (d) preheating at a temperature of not less than about 200° C. and not more than about 600° C. while vacuum-evacuating the treatment space; (e) after the preheating, hermetically sealing the treatment space while the treatment space is in a reduced-pressure state or contains an inert gas; and (f) a diffusion step including, after (e), heating the treatment container to a treatment temperature of not less than about 450° C. and not more than about 1000° C.

In one embodiment, the diffusion sources are RH diffusion sources including at least one of Dy and Tb.

In one embodiment, the diffusion sources are RH diffusion sources including at least one of Dy and Tb and is powder including particles of not more than 90 μm in size.

In one embodiment, the RH diffusion sources include a heavy rare earth element RH (at least one of Dy and Tb) and Fe in the proportion of not less than 30 mass % and not more than 80 mass %.

Advantageous Effects of Invention

According to an embodiment of the present invention, a diffusion treatment device which is capable of performing a diffusion treatment with higher mass production efficiency than the above-described conventional manufacturing devices while reducing formation of chips and a method for manufacturing an R-T-B sintered magnet with the use of the diffusion treatment device are provided.

BRIEF DESCRIPTION OF DRAWINGS

FIG. 6(*b*) is a schematic perspective view of a diffusion source 2. FIG. 6(*c*) is a schematic perspective view of an agitation assisting member 3.

DESCRIPTION OF EMBODIMENTS

Hereinafter, a diffusion treatment device and a method for manufacturing an R-T-B sintered magnet with the use of the diffusion treatment device, which are according to an embodiment of the present invention, are described with reference to the drawings. The embodiment of the present invention is not limited to examples which will be described below.

Figure 1:
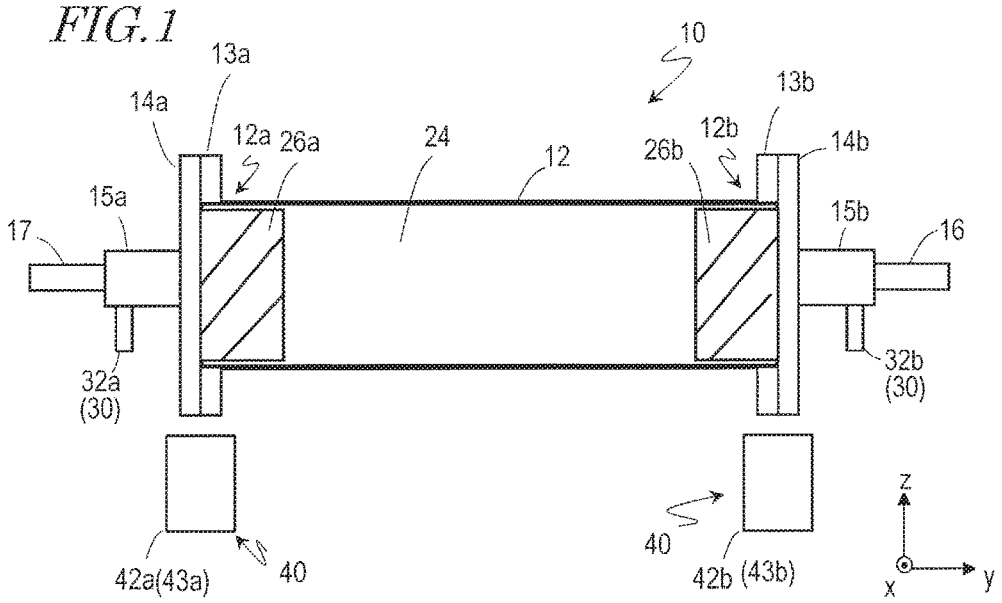
FIG. 1 is a schematic lateral cross-sectional view of a treatment container 10 included in a diffusion treatment device of an embodiment of the present invention.

A diffusion treatment device of an embodiment of the present invention is characterized in including a treatment container 10 shown in FIG. 1. The treatment container 10 includes a first lid 14*a* and a second lid 14*b* which are capable of hermetically sealing a first opening 12*a* and a second opening 12*b* at opposite ends of a cylindrical main body 12. The main body 12 includes a treatment space 24 which is capable of receiving a plurality of R-T-B sintered magnet pieces (hereinafter, also abbreviated as "magnet pieces") and diffusion sources. Here, the diffusion sources are not limited to conventional RH diffusion sources as will be described later, but may be an alloy of a light rare earth element RL and Ga or Cu.

Loading of the magnet pieces and the diffusion sources into the treatment space 24 is realized through the first opening 12*a* and/or the second opening 12*b*. The treatment container 10 only needs to be configured such that at least one of the first opening 12*a* and the second opening 12*b* is hermetically sealed by the detachable first lid 14*a* or the detachable second lid 14*b*. That is, one of the first opening 12*a* and the second opening 12*b*, e.g., the second opening 12*b*, may be sealed by the second lid 14*b* integrated with the main body 12. In this specification, the second lid 14*b* includes a lid integrated with the main body 12.

The treatment container 10 is moved between stages of the diffusion treatment device for performing a diffusion treatment on the magnet pieces. A diffusion treatment device disclosed in Japanese Patent Application No. 2015-068831 of the present applicant includes a cooling section connected with a diffusion furnace, and magnet pieces are moved from the diffusion furnace to the cooling section. On the other hand, in the diffusion treatment device of an embodiment of the present invention, the treatment container 10 loaded with magnet pieces is moved between stages of the diffusion treatment device. In the following section, the configuration and operation of the diffusion treatment device will be described with an example in which the lengthwise direction of the treatment container is located along the y-axis in a rectangular coordinate system xyz (right-handed rectangular coordinate system) where a z-axis direction is a vertical direction.

Figure 4:
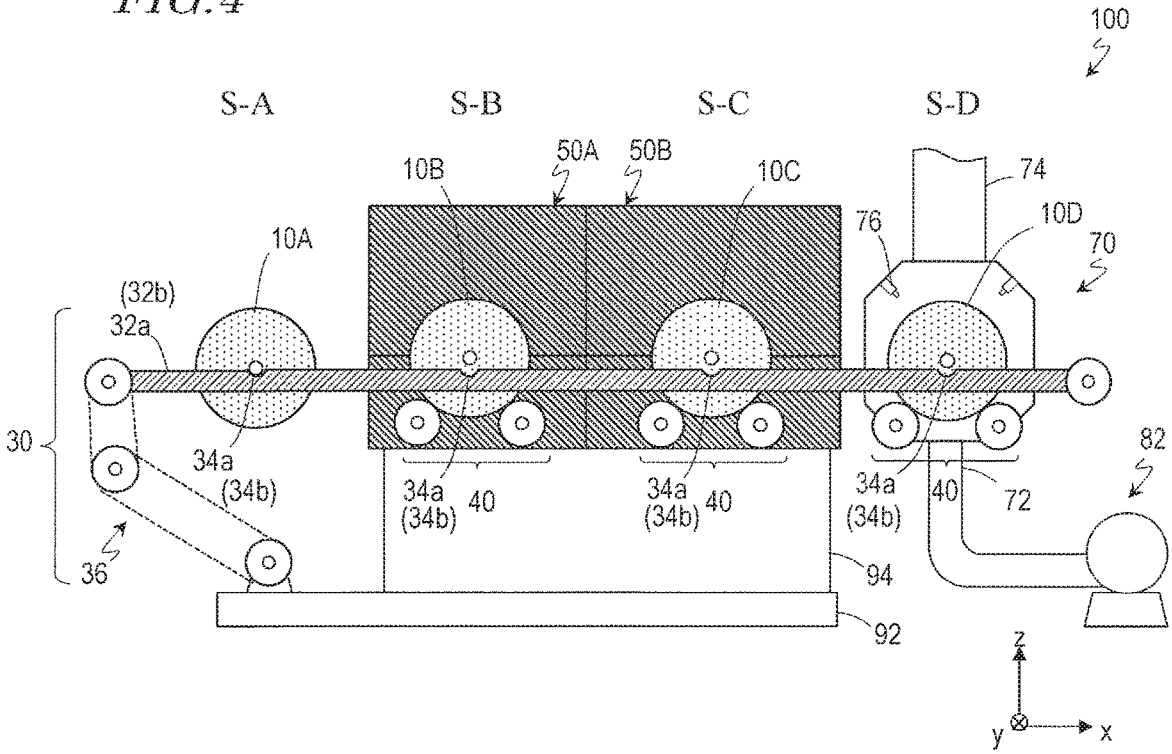
FIG. 4 is a schematic diagram of a diffusion treatment device 100 of an embodiment of the present invention.

The diffusion treatment device of an embodiment of the present invention has, for example, four stages A to D as in a diffusion treatment device 100 shown in FIG. 4. Stage A (S-A) is a preparatory stage for, for example, reception of the treatment container 10 loaded with magnet pieces and diffusion sources, vacuum-evacuation of the treatment container 10, leakage check, etc. Stage B (S-B) is a stage for preheating the treatment container 10 to, for example, about 600° C. Stage C (S-C) is a stage for performing a heat treatment such that a desired element which will be described later is diffused into the magnet pieces (e.g., heating to a temperature of not less than about 450° C. and not more than about 1000° C.). Stages B and C can be realized in the same stage (heating unit). Subsequent stage D (S-D) is a stage for cooling the treatment container 10. In stage D, air cooling and water cooling may be performed. The diffusion treatment device includes a conveyor for conveying the treatment container 10 sequentially from stage A to stage D by predetermined distances. Details of these components will be described later.

The diffusion treatment device of an embodiment of the present invention only needs to include at least a treatment container 10, a conveyor 30 for conveying the treatment container 10 by a predetermined distance in an x-axis direction while a longitudinal direction of the treatment container 10 is located in a y-axis direction, a heating unit 50 for performing stages B and C (see FIG. 2 and FIG. 3), and a first rotating unit 40 for rotating the treatment container 10 around the y-axis while the treatment container 10 is heated to a certain temperature (e.g., exceeding about 600° C.). According to an embodiment of the present invention, during the stage of cooling (during the process of the aforementioned stage S-D) or after the aforementioned stage S-D, a heat treatment for diffusing a desired element (aforementioned stage S-C) can be performed simultaneously while the magnet pieces and the diffusion sources are taken out from the treatment container. Therefore, the diffusion treatment can be performed with high mass production efficiency as compared with the manufacturing devices disclosed in Patent Documents 2 and 3 in which the aforementioned stage S-C cannot be performed during the aforementioned stage S-D or during the takeout of the magnet pieces and the diffusion sources from the treatment container after the aforementioned stage S-D.

The configuration of the treatment container 10 is described in detail with reference to FIG. 1. The treatment container 10 includes a cylindrical main body 12 which has a first opening 12*a* and a second opening 12*b* at opposite ends, and a first lid 14*a* and a second lid 14*b* which are capable of hermetically sealing the first opening 12*a* and the second opening 12*b*, respectively. The treatment container 10 further includes a first flange 13*a* and a second flange 13*b* at opposite ends in the longitudinal direction. When the first lid 14*a* is secured to the first flange 13*a* and the second lid 14*b* is secured to the second flange 13*b*, the first opening 12*a* and the second opening 12*b* are respectively hermetically sealed. Note that, however, as previously described, when the second lid 14*b* is integrated with the main body 12 in the treatment container 10, the second flange 13*b* may be integrated with the main body 12 together with the second lid 14*b*.

When necessary, for example, O-rings, or the like, may be provided between the first lid 14*a* and the first flange 13*a* and between the second lid 14*b* and the second flange 13*b*. These hermetical sealing structures are not limited to those illustrated as examples but can employ known structures. The main body 12 is made of, for example, stainless steel (e.g., JIS standard SUS310S). The material of the main body 12 is arbitrary so long as it has thermal tolerance to the heat treatment for the diffusion treatment (a temperature of not less than about 450° C. and not more than about 1000° C.) and is unlikely to react with the magnet pieces and the diffusion sources including an element which will be described later. For example, Nb, Mo, W, or an alloy including at least one of these elements may be used. The inside diameter of the main body 12 is, for example, 300 mm. The outside diameter of the main body 12 is, for example, 320 mm. The overall length of the main body 12 is, for example, 2000 mm. The length of the treatment space 24 is, for example, 1000 mm. According to an embodiment of the present invention, the diffusion treatment can be performed with high mass production efficiency as described above. Therefore, it is not necessary to increase the height of the main body 12 (the inside diameter and the length of the external shape) for the purpose of increasing the throughput. Therefore, formation of chips in the magnet pieces can be reduced. Since the flanges 13*a*, 13*b* and the lids 14*a*, 14*b* are not required to have high thermal tolerance, other metal materials than stainless steel can be used. The outside diameter of the flanges 13*a*, 13*b* and the lids 14*a*, 14*b* is, for example, 450 mm.

The treatment container 10 includes a first heat insulator 26*a* provided on the first opening 12*a* side of the treatment space 24 and a second heat insulator 26*b* provided on the second opening 12*b* side of the treatment space 24. The first heat insulator 26*a* and the second heat insulator 26*b* include, for example, a heat insulation fiber. The heat insulation fiber is, for example, carbon fiber or ceramic fiber.

The first lid 14*a* and the second lid 14*b*, which are in the shape of a circular plate, include cylindrical portions 15*a* and 15*b* protruding from the centers of the respective lids (which are coincident with the center of the cylindrical main body 12). The cylindrical portion 15*b* of the second lid 14*b* is provided with a connecting portion 16. By switching pipes which are to be connected with the connecting portion 16, the treatment space 24 of the main body 12 can be vacuum-evacuated or charged with a gas (inert gas). The connecting portion 16 may be realized by, for example, a manual valve or a coupler. Further, a valve (not shown) may be provided on the cylindrical portion 15*b* side of the connecting portion 16. By closing the valve, the internal state of the treatment space 24 (e.g., reduced-pressure state) can be maintained more favorably. The pipe for vacuum-evacuation is connected with, for example, an oil rotary pump (RP) and a mechanical booster pump (MBP) such that, preferably, the treatment space 24 can be vacuum-evacuated to not more than 10 Pa. As for the hermeticity of the treatment container 10, it is preferred that a reduced-pressure state of not more than 10 Pa can be maintained for not less than 10 hours. Herein, the "inert gas" is, for example, a noble gas such as argon (Ar). However, a gas which would not cause a chemical reaction with the magnet pieces or the diffusion sources can be included in the "inert gas".

Meanwhile, the cylindrical portion 15*a* of the first lid 14*a* is provided with a safety valve 17. When the pressure inside the treatment space 24 is excessively increased, the safety valve 17 allows leakage of the inert gas from the treatment space 24, thereby adjusting the pressure inside the treatment space 24 so as not to exceed a predetermined pressure. As a matter of course, the safety valve 17 can be omitted. The arrangement of the cylindrical portion 15*a* and the cylindrical portion 15*b* may be reversed.

The cylindrical portions 15*a* and 15*b* are used in placing the treatment container 10 on the conveyor 30. As shown in FIG. 1, in placing the treatment container 10 on supporting plates 32*a* and 32*b* of the conveyor 30, the cylindrical portions 15*a* and 15*b* of the treatment container 10 are fit in recesses 34*a* and 34*b* of the supporting plates 32*a* and 32*b*, respectively. While this state is maintained, the supporting plates 32*a* and 32*b* are moved in the x-axis direction by a predetermined distance, whereby the treatment container 10 is conveyed. As will be described later with reference to FIG. 4, the supporting plates 32*a* and 32*b* have a plurality of recesses 34*a* and 34*b* arranged with predetermined intervals in the x-axis direction such that a plurality of treatment containers 10 can be simultaneously conveyed between different stages.

Figure 3:
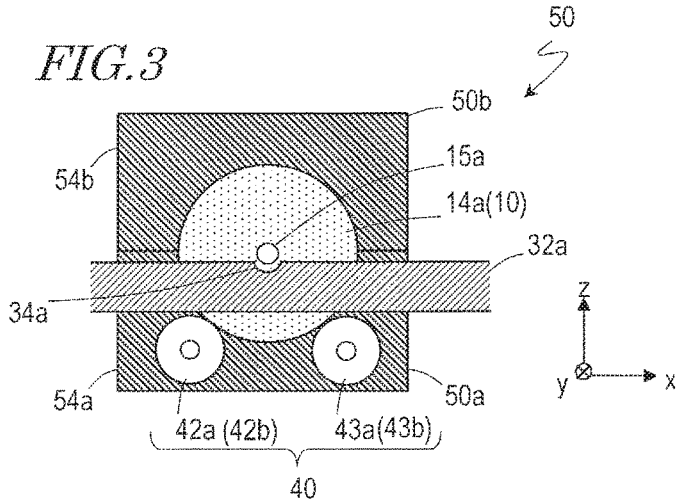
FIG. 3 is a schematic diagram of a heating unit 50 included in a diffusion treatment device of an embodiment of the present invention, which is in a closed state.

The first rotating unit 40 includes a first wheel pair 42*a*, 43*a* which is in contact with at least one of the first flange 13*a* and the first lid 14*a* and a second wheel pair 42*b*, 43*b* which is in contact with at least one of the second flange 13*b* and the second lid 14*b* (see FIG. 1 and FIG. 3). The first wheel pair 42*a*, 43*a* and the second wheel pair 42*b*, 43*b* respectively include two wheels 42*a*, 43*a* and two wheels 42*b*, 43*b*, each of which is located along the x-axis direction and is rotatable around the y-axis. The two wheels 42*a*, 43*a* and the two wheels 42*b*, 43*b* included in the first wheel pair 42*a*, 43*a* and the second wheel pair 42*b*, 43*b*, respectively, have a variable rotation speed and/or are reversely rotatable. Since the wheels 42*a*, 43*a* and the wheels 42*b*, 43*b* rotate the treatment container 10 around the y-axis at a predetermined speed, the wheels 42*a*, 43*a* and the wheels 42*b*, 43*b* rotate in the same direction at the same speed. So long as the four wheels can rotate in the same direction at the same speed, the four wheels may be controlled independently of one another. The rotation speed is, for example, 0.3 rpm to 1.5 rpm (circumferential velocity: about 280 mm/min to about 1400 mm/min). If the rotation speed is excessively high, formation of chips in the magnet pieces is more likely to occur.

Figure 2:
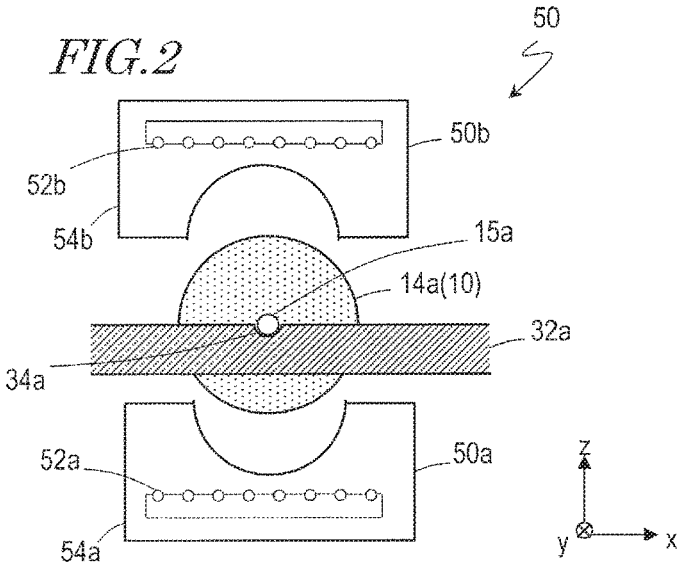
FIG. 2 is a schematic diagram of a heating unit 50 included in a diffusion treatment device of an embodiment of the present invention, which is in an opened state.

Next, the configuration and operation of a heating unit 50 included in the diffusion treatment device of an embodiment of the present invention are described with reference to FIG. 2 and FIG. 3. FIG. 2 is a schematic diagram of the heating unit 50 which is in an opened state. FIG. 3 is a schematic diagram of the heating unit 50 which is in a closed state. Note that FIG. 1 described above corresponds to the side view of FIG. 2 from which the heating unit 50 is omitted. As shown in FIG. 2, when the heating unit 50 is in the opened state, the treatment container 10 is supported on the supporting plates 32*a* and 32*b* of the conveyor 30.

The heating unit 50 includes a lower heating section 50 provided under the treatment container 10 and an upper heating section 50*b* provided above the treatment container 10. At least one of the lower heating section 50*a* and the upper heating section 50*b* is movable in the z-axis direction. Preferably, as shown in FIG. 2 and FIG. 3, both the lower heating section 50*a* and the upper heating section 50*b* are movable in the z-axis direction. For example, when only the upper heating section 50*b* is movable in the z-axis direction, it is necessary for conveyance of the treatment container 10 that the supporting plates 32*a* and 32*b* are first raised (moved in the z-axis direction) and the treatment container 10 is moved out of the lower heating section 50*a*, and thereafter, the treatment container 10 is conveyed to the subsequent stage (moved in the x-axis direction) before the supporting plates 32*a* and 32*b* are lowered (moved in the z-axis direction). In this case, the treatment container 10 is moved not only in the x-axis direction but also in the z-axis direction, and therefore, the configuration of the device is complicated. Since the treatment container 10 is not only conveyed in the x-axis direction but also moved twice in the z-axis direction (raised and lowered), the conveyance time is long, and accordingly, the temperature of the treatment container 10 decreases more than expected. Thus, in the subsequent stage, an extra time is necessary before a desired temperature is reached. If the lower heating section 50*a* and the upper heating section 50*b* are each movable in the z-axis direction, movement of the supporting plates 32*a* and 32*b* in the z-axis direction (raising and lowering) is unnecessary.

Further, the lower heating section 50*a* and the upper heating section 50*b* can be simultaneously moved in the z-axis direction (vertical direction). The distance of movement in the z-axis direction of each of the lower heating section 50*a* and the upper heating section 50*b* is shorter than the distance of movement in the z-axis direction of the upper heating section 50*b* in a case where only the upper heating section 50*b* is movable in the z-axis direction. This is because, when the lower heating section 50*a* and the upper heating section 50*b* are simultaneously moved in the z-axis direction (vertical direction), the distance of movement of each of the lower heating section 50*a* and the upper heating section 50*b* is such that the heating section only needs to be moved to a position at which it would not be in contact with the treatment container 10 (by a distance approximately equal to the radius of the treatment container 10) since the supporting plates 32*a* and 32*b* do not move in the z-axis direction (vertical direction) whereas, when only the upper heating section 50*b* is movable in the z direction, in the subsequent steps of raising the supporting plates 32*a* and 32*b* (moving the supporting plates 32*a* and 32*b* in the z-axis direction) and moving the treatment container 10 out of the lower heating section 50*a* and thereafter conveying the treatment container 10 to the subsequent stage (moving the treatment container 10 in the x-axis direction), it is necessary to additionally raise the upper heating section 50*b* by a distance equal to the distance traveled by the raised supporting plates 32*a* and 32*b* (movement in the z-axis direction) such that the treatment container 10 would not hit the upper heating section 50*b*. For these reasons, the conveyance time can be greatly shortened. Thus, the treatment container 10 can be efficiently heated with only a small decrease in the temperature of the treatment container 10.

The lower heating section 50*a* and the upper heating section 50*b* respectively include heaters 52*a*, 52*b* and hoods 54*a*, 54*b*. As the heaters 52*a*, 52*b*, for example, a metal heater can be used. When the heating unit 50 is in a closed state as shown in FIG. 3, the lower heating section 50*a* and the upper heating section 50*b* are arranged so as to surround at least a central part of the treatment container 10. In this case, it is preferred that the part of the treatment container 10 surrounded by the heating unit 50 includes the entirety of the treatment space 24, a portion of the first heat insulator 26*a* and a portion of the second heat insulator 26*b*. When the heating unit 50 is in the closed state, the diameter of the circle formed by the hood 54*a* and the hood 54*b* is smaller than the diameter of the lid 14*a* (14*b*) of the treatment container 10 (e.g., 450 mm) and slightly larger than the outside diameter of the main body 12 of the treatment container 10 (e.g., 320 mm). For example, the clearance is 5 mm. By thus surrounding the treatment container 10 with the hoods 54*a*, 54*b* of the heating unit 50, the temperature inside the treatment space 24 of the treatment container 10 can be increased uniformly and efficiently. While the treatment container 10 is conveyed, the heating unit 50 is in the opened state. However, heated air resides in the hoods 54*a* and 54*b*. Therefore, the heat is unlikely to dissipate and, when the heating unit 50 is again in the closed state, an intended temperature can be reached relatively quickly.

The heating unit 50 preferably further includes a lid (not shown). When the heating unit 50 is in the closed state while the treatment container 10 is not placed in the heating unit 50, the lid is located so as to close a circular opening formed by the hood 54*a* and the hood 54*b*. For example, before the treatment container 10 is placed in the heating unit 50, the lid is closed during preheating of the heating unit 50, whereby the temperature inside the space surrounded by the hood 54*a* and/or the hood 54*b* can be kept uniform. Note that, preferably, a thermocouple (not shown) is provided at a position near the treatment container 10 inside the space surrounded by the hood 54*a* and/or the hood 54*b* for monitoring the temperature.

When the heating unit 50 is in the closed state, the treatment container 10 is supported on the first wheel pair 42*a*, 43*a* and the second wheel pair 42*b*, 43*b* of the rotating unit 40, and the treatment container 10 is detached from the conveyor 30, i.e., from the supporting plates 32*a* and 32*b*. While the treatment container 10 is heated, particularly while the treatment container 10 is heated to a temperature exceeding about 600° C., the treatment container 10 is preferably rotated by the rotating unit 40. If the temperature of the magnet pieces exceeds about 600° C., there is a probability that the treatment container 10 deforms. As a matter of course, in the diffusion treatment step (not less than about 450° C. and not more than about 1000° C.), the treatment container 10 is rotated in order to uniformly and frequently provide the chances for the magnet pieces and the diffusion sources to be in the vicinity of each other or in contact with each other.

The diffusion treatment device of an embodiment of the present invention preferably further includes a supporting mechanism which is capable of adjusting the horizontality of the entire device. While the treatment container 10 is rotated around the y-axis, the magnet pieces and the diffusion sources in the treatment space 24 basically do not move in the y-axis direction. As a matter of course, positional changes in the y-axis direction can occur during the rotation due to collision between the magnet pieces and collision of the magnet pieces with the inner wall of the treatment container 10. However, such a movement of the magnet pieces would not cause an uneven distribution of the magnet pieces. That is, it is preferred that after the magnet pieces and the diffusion sources are loaded into the treatment space 24 such that they are distributed uniformly in the y-axis direction, the treatment container 10 is kept horizontal such that an uneven distribution of the magnet pieces and the diffusion sources in the y-axis direction would not occur till they undergo a diffusing heat treatment and are cooled to, for example, a temperature lower than 600° C.

Figure 6:
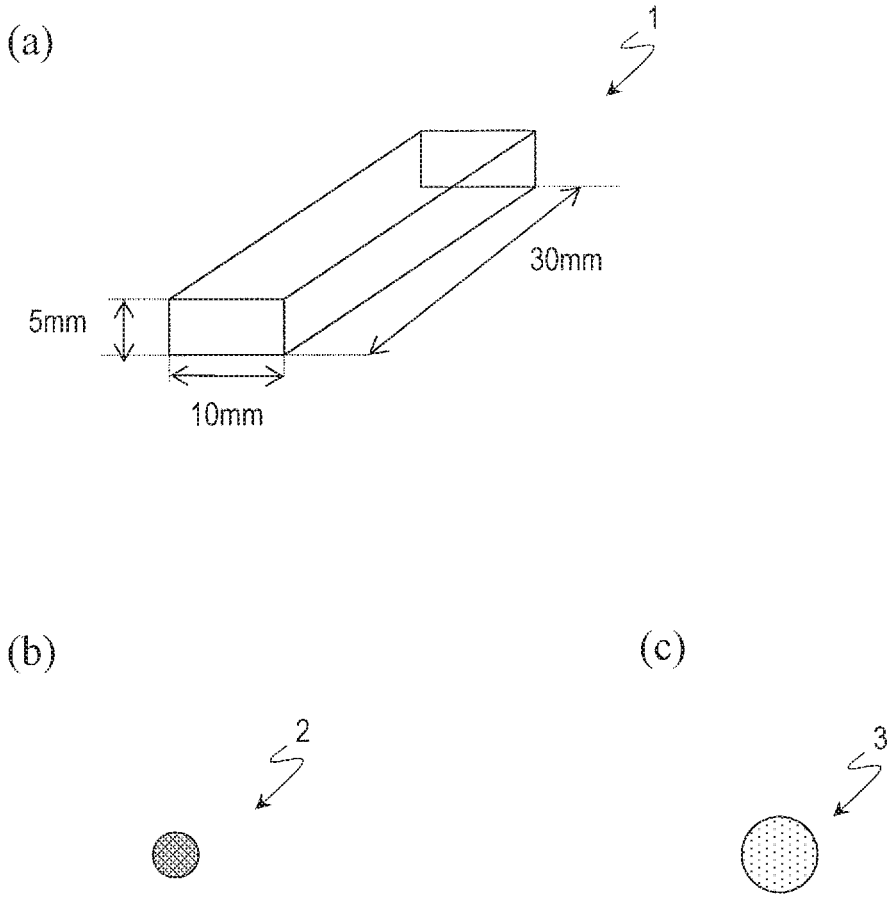
FIG. 6(*a*) is a schematic perspective view of an R-T-B sintered magnet piece 1.

For example, magnet pieces 1, diffusion sources 2 and agitation assisting members 3 schematically shown in FIGS. 6(*a*) to 6(*c*) are loaded into the treatment container 10. The agitation assisting members 3 are optionally mixed in and can be omitted.

The magnet piece 1 may have, for example, a small, elongated shape (e.g., 30 mm in length×10 mm in width×5 mm in thickness) as shown in FIG. 6(*a*). The magnet piece 1 is an R-T-B sintered magnet piece which has such a composition that for example the amount of R, which is defined by the content of the rare earth element, is not less than 29 mass % and not more than 40 mass %. When R is less than 29 mass %, there is a probability that high coercivity is not achieved. On the other hand, when R exceeds 40 mass %, alloy powder in the manufacturing process of the magnet piece 1 is very active, and there is a probability that considerable oxidation or flaming of the powder occurs. Preferably, the amount of R is not less than 31 mass % and not more than 37 mass % as disclosed in Patent Document 3. This is because the heavy rare earth element RH can be diffused within a short time period, and $H_{cJ}$ can be improved without decreasing $B_r$.

The R-T-B sintered magnet piece 1 preferably has the following composition:

Amount of R: not less than 29 mass % and not more than 40 mass %;

B (some of B may be replaced by C): not less than 0.85 mass % and not more than 1.2 mass %;

Additive element M (at least one selected from the group consisting of Al, Ti, V, Cr, Mn, Ni, Cu, Zn, Ga, Zr, Nb, Mo, Ag, In, Sn, Hf, Ta, W, Pb and Bi): 0 to not more than 2 mass %; and T (transition metals, typically Fe, which may include Co) and unavoidable impurities: remaining part.

Here, R is a rare earth element, for example, Nd, Pr, Dy or Tb. Typically, at least one selected from Nd and Pr, which are light rare earth elements RL, is included, although at least one of Dy and Tb, which are heavy rare earth elements RH, may be included.

The diffusion sources 2 only need to be a known metal or alloy including an element which has the effect of improving the magnetic properties of the magnet pieces (e.g., improvement in $H_{cJ}$). For example, the diffusion sources 2 are not limited to conventional diffusion sources which include a heavy rare earth element RH but may be an alloy of a light rare earth element RL and Ga or an alloy of a light rare earth element RL and Cu. As the alloy of a light rare earth element RL and Ga or Cu, an alloy disclosed in, for example, Japanese Patent Application No. 2015-150585 can be used. The entire disclosure of Japanese Patent Application No. 2015-150585 is incorporated by reference in this specification.

As the diffusion sources 2, for example, RH diffusion sources including a heavy rare earth element RH (at least one of Dy and Tb) is used. The RH diffusion sources include a heavy rare earth element RH (at least one of Dy and Tb)

and Fe in the proportion of not less than 30 mass % and not more than 80 mass %. Typically, the RH diffusion sources are made of a FeDy alloy or a TbFe alloy. Using Dy rather than Tb can achieve higher $H_{cJ}$. The content of RH is preferably not less than 20 mass % and not more than 70 mass %. If the content of RH is less than 20 mass %, the amount of supplied heavy rare earth element RH decreases, and there is a probability that high $H_{cJ}$ is not achieved. If the content of RH exceeds 70 mass %, there is a probability that RH diffusion sources flame in the step of loading the RH diffusion sources into the treatment container. The content of the heavy rare earth element RH in the RH diffusion sources is preferably not less than 35 mass % and not more than 65 mass %, more preferably not less than 40 mass % and not more than 60 mass %. The RH diffusion sources may include at least one of Nd, Pr, La, Ce, Zn, Zr, Sm and Co instead of Tb, Dy or Fe so long as the effects of the present invention are not marred. As the unavoidable impurities, Al, Ti, V, Cr, Mn, Ni, Cu, Ga, Nb, Mo, Ag, In, Hf, Ta, W, Pb, Si and Bi may be further included.

The form of the diffusion source 2 is, for example, a sphere (e.g., not more than 2 mm in diameter) as shown in FIG. 6(*b*). The form of the diffusion source 2 may be an arbitrary form other than sphere, such as linear, plate, block, powder, etc. When the diffusion source 2 has the shape of a ball or wire, the diameter of the diffusion source 2 can be set to, for example, several millimeters to several centimeters.

The agitation assisting members 3 enhance the chances of contact between the diffusion sources 2 and the magnet pieces 1 and also serves to indirectly supply the magnet pieces 1 with the diffusion sources 2 once adhering to the agitation assisting members 3. Also, the agitation assisting members 3 serve to prevent formation of chips and fusion in the treatment space 24 due to contact between the magnet pieces 1 and contact of the magnet pieces 1 with the diffusion sources 2. The agitation assisting members 3 are suitably made of, for example, zirconia, silicon nitride, silicon carbide and boron nitride, or a ceramic of a mixture thereof. Alternatively, the agitation assisting members 3 can be made of an element of the group including Mo, W, Nb, Ta, Hf and Zr or a mixture thereof. The form of the agitation assisting member 3 is, for example, a sphere (e.g., 5 mm in diameter) as shown in FIG. 6(*c*).

If the amount of the loaded agitation assisting members 3 is excessive, there is a probability that the magnet pieces 1 and the diffusion sources 2 are not uniformly agitated, and there is a probability that a single diffusion treatment cannot achieve sufficient coercivity improving effect and/or the coercivity becomes nonuniform. Thus, the amount of the loaded agitation assisting members 3 is adjusted so as not to be excessive. Preferred amounts of the loaded materials are in the mass proportion of Magnet Pieces 1:Diffusion sources 2:Agitation assisting members 3=1:1:1.

The form of the RH diffusion sources can be powder. In this case, as disclosed in Japanese Patent Application No. 2015-037790, using powder which mainly includes alloy particles of not more than 90 μm in size is preferred. The entire disclosure of Japanese Patent Application No. 2015-037790 is incorporated by reference in this specification.

The particles of not more than 90 μm in size refer to particles classified using a sieve with 90 μm openings (JIS Z 8801-2000 standard sieve). When using powder which mainly includes particles of not more than 90 μm in size, high $H_{cJ}$ can be stably achieved. Powder consisting only of particles of not more than 90 μm in size can be prepared by pulverizing an alloy including a heavy rare earth element RH by a known method, such as a pin mill pulverizer, and classifying the pulverized alloy using a sieve with 90 μm openings. The size of the particles is preferably not less than 38 μm and not more than 75 μm, more preferably not less than 38 μm and not more than 63 μm. This is because high $H_{cj}$ can be achieved more stably. If many particles of less than 38 μm are included, there is a probability that the RH diffusion sources flame because the particles are excessively small.

The powder preferably includes particles over which a fresh surface is exposed at least in part. Herein, "fresh surface is exposed" refers to a condition where foreign substances other than the RH diffusion sources, for example, an oxide of R or R-T-B compound (compound whose composition is closer to the primary phase), are not present at the surface of the particles. Since the powder is prepared by pulverizing an alloy including a heavy rare earth element RH, the resultant powder includes particles over which a fresh surface is exposed at least in part. However, when the RH diffusion treatment is repeatedly performed, even if particles of not more than 90 μm in size are present after the diffusion treatment, some of the particles after the diffusion treatment are entirely covered with foreign substances, oxides of R, etc., so that a fresh surface is not exposed. Therefore, when the diffusion treatment is performed repeatedly using particles which have undergone the treatment, there is a probability that the supply of the heavy rare earth element RH to the magnet pieces decreases due to foreign substances, oxides of R, etc. Thus, it is preferred that the particles which have undergone the treatment are pulverized by a known pulverizer, or the like, such that fracture faces of the particles are exposed, i.e., fresh surfaces are exposed.

When powder is used as the RH diffusion sources, it is preferred that particles in the mass proportion of not less than 2% and not more than 15% relative to the magnet pieces are loaded into the treatment container 10. In this case, high $H_{cj}$ can be stably achieved by performing the process of carrying out the RH diffusion treatment. If the particles of not more than 90 μm in size are in the mass proportion of less than 2% relative to the magnet pieces, the amount of particles of not more than 90 μm is excessively small, so that high $H_{cJ}$ cannot be stably achieved. If the particles of not more than 90 μm in size are in the mass proportion of more than 15% relative to the magnet pieces, the particles cause an overreaction with the liquid phase oozing out from the magnet pieces, so that abnormal adhesion of the particles to the surfaces of the magnet pieces occurs. This phenomenon impedes supply of additional heavy rare earth element RH to the magnet pieces, so that high $H_{cj}$ cannot be stably achieved. Therefore, although the powder consisting only of particles of not more than 90 μm is necessary for stably achieving high $H_{cJ}$, the amount of the powder is preferably within a specific range (in the mass proportion of not less than 2% and not more than 15%) and is preferably in the mass proportion of not less than 3% and not more than 7% relative to the magnet pieces.

When the powder consisting only of particles of not more than 90 μm in size is loaded in the mass proportion of not less than 2% and not more than 15% relative to the magnet pieces, for example, additional particles of more than 90 μm in size may be further loaded. Note that, however, the magnet pieces and the alloy powder (the total of particles of not more than 90 μm in size and particles of more than 90 μm in size) are preferably loaded into the treatment container such that they are in the mass proportion of 1:0.02 to 2.

Also when the above-described powder is used as the RH diffusion sources, using the agitation assisting members 3 is preferred. In this case, a preferred amount of the loaded agitation assisting members 3 is in the mass proportion of Magnet Pieces 1:RH Diffusion sources:Agitation assisting members 3=1:0.03:1.

When the RH diffusion sources used is powder which mainly includes particles of not more than 90 μm in size, the RH diffusion sources can be used up in one treatment cycle, and it contributes to reduction in the consumption of the RH diffusion sources and reduction in the diffusion treatment time.

Figure 5:
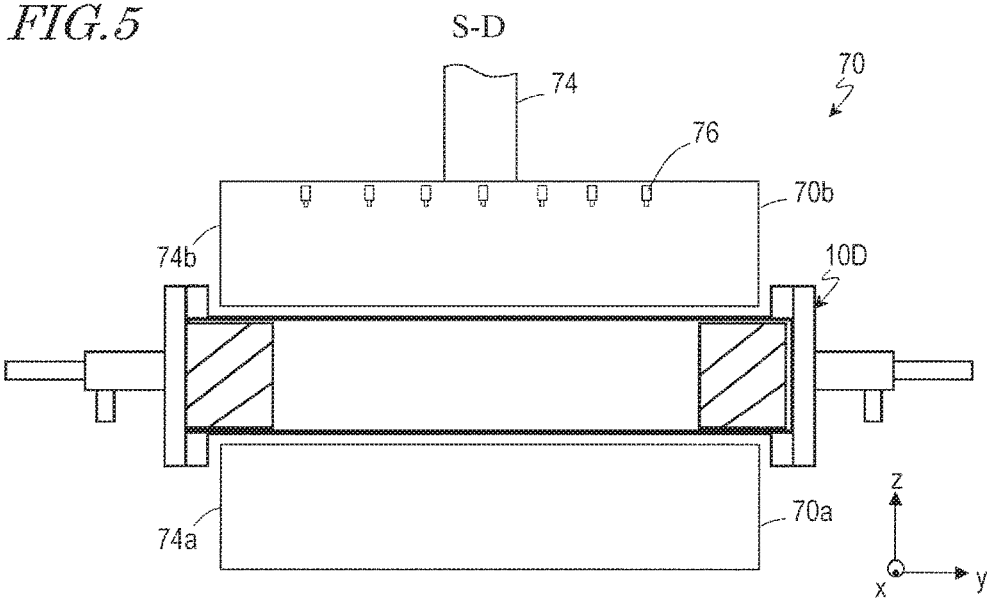
FIG. 5 is a schematic diagram of a cooling unit 70 included in the diffusion treatment device 100 of an embodiment of the present invention, which is in an opened state.

Next, the configuration and operation of the diffusion treatment device 100 of an embodiment of the present invention are described with reference to FIG. 4 and FIG. 5. FIG. 4 is an overall schematic diagram of the diffusion treatment device 100. FIG. 5 is a schematic diagram of a cooling unit 70 included in the diffusion treatment device 100, which is in an opened state.

As shown in FIG. 4, the diffusion treatment device 100 has four stages A to D. The diffusion treatment device 100 can be operated such that the treatment containers 10A to 10D are arranged such that, for example, each stage holds a single treatment container as shown in the diagram.

Stage A (S-A) is a preparatory stage for, for example, reception of the treatment container 10A loaded with the magnet pieces 1 and the diffusion sources 2, vacuum-evacuation of the treatment container 10A, leakage check, etc.

Loading of the magnet pieces 1 and the diffusion sources 2, and the optionally-added agitation assisting members 3 into the treatment container 10A is carried out, for example, before stage A. For example, the diffusion treatment device 100 further includes a loading unit (not shown) prior to stage A in FIG. 4. The loading unit is capable of inclining the treatment container 10A in the yz plane while the longitudinal direction of the treatment container 10 is located in the y-axis direction. The loading unit includes, for example, two wheel pairs which have the same configuration as that of the two wheel pairs 42*a*, 42*b* and 43*a*, 43*b* of the rotating unit 40. The two wheel pairs support the treatment container 10A. Also, the two wheel pairs are capable of inclining in the yz plane.

The main body 12 (from which the lid 14*a* and the heat insulator 26*a* have been taken off) is placed on the two wheel pairs and, for example, inclined in the yz plane by 20° to 30° from the horizontal plane (xy plane). For example, the magnet pieces 1, the diffusion sources 2 and the agitation assisting members 3 are loaded from the opening 12*a* of the main body 12 (an opening at a high position). Note that, at the timing of the loading, the lid 14*b* and the heat insulator 26*b* are already inserted in an opening at a low position. For example, the magnet pieces 1 and other materials are placed on a shovel, and then, the magnet pieces 1 are placed in the main body 12 sequentially from the deepest end of the main body 12 (e.g., the side close to the opening 12*b*). The process of placing the magnet pieces 1 is separated into multiple periods such that the distribution of the magnet pieces 1 and other materials in the y-axis direction in the treatment space 24 of the treatment container 10A is uniform. Alternatively, a shovel whose length in the y-axis direction is generally equal to the treatment space 24 may be used. The magnet pieces 1 and other materials are arranged on the shovel such that their distribution is uniform. This shovel is inserted to a predetermined position inside the treatment container 10A, whereby the magnet pieces 1 and other materials are arranged at one time inside the treatment space 24.

Thereafter, the heat insulator 26*a* is inserted, and the lids 14*a* and 14*b* are secured to the flanges 13*a* and 13*b* with bolts and nuts via, for example, O-rings, whereby the treatment container 10A is hermetically sealed. This treatment container 10A is placed on the supporting plates 32*a* and 32*b* of the conveyor 30 using, for example, a forklift (stage A).

In stage A, the treatment container 10A is supported on the recesses 34*a* and 34*b* of the supporting plates 32*a* and 32*b*. Here, the connecting portion 16 of the treatment container 10A is connected with a pipe for vacuum evacuation, and the pressure inside the treatment container 10 is reduced to, for example, 10 Pa or lower. In this state, leakage check in the treatment container 10 is carried out. In the leakage check, for example, after the treatment container 10 is left alone for about 10 minutes, the pressure is checked again. If the checked pressure is within a predetermined pressure range (e.g., not more than 10 Pa), the treatment container 10A is determined to be OK. When NG, the above-described procedure is repeated till causes of leakage are eliminated. After being determined to be OK at stage A, the treatment container 10A is conveyed to subsequent stage B.

Here, the treatment container 10A is conveyed in a pitched manner by a predetermined distance in the x-axis direction. The four recesses 34*a* of the supporting plate 32*a* (and the four recesses 34*b* of the supporting plate 32*b*) of the conveyor 30 correspond to respective ones of the stages of the diffusion treatment device 100. The distances (in the x-axis direction) between the respective stages are constant, and the distances between recesses 34*a* adjoining in the x-axis direction are also constant. This is also referred to as "pitch". When the treatment container 10A at stage A is conveyed to subsequent stage B in the x-axis direction, the treatment containers 10B, 10C and 10D at the other stages are also simultaneously conveyed by one stage (by one pitch) in the x-axis direction. Therefore, preferably, the process durations in respective stages are generally equal. As a matter of course, a standby time may be provided in a specific stage. However, for example, in the case of the heating step, the container needs to be on standby at a temperature lower than the predetermined temperature. Therefore, it is necessary to control increase and/or decrease of the temperature, and it can be a cause to deteriorate the repeatability of the heat treatment.

The conveyor 30 is located on a first chassis 92 and can advance and withdraw the supporting plates 32*a* and 32*b* in the x-axis direction by an actuator 36. The first chassis 92 includes a supporting mechanism which is capable of adjusting the supporting plates 32*a* and 32*b* of the conveyor 30 so as to be horizontal.

Stage B (S-B) is a stage for preheating the treatment container 10B to, for example, 600° C. The preheating is carried out at a temperature of not less than about 200° C. and not more than about 600° C. while the treatment space 24 is vacuum-evacuated. The connecting portion 16 of the treatment container 10B is kept connected with the pipe for vacuum evacuation since stage A. A heating unit 50A and a heating unit 50B at subsequent stage C (S-C) can have the same configuration as that of the heating unit 50 that has previously been described with reference to FIG. 2 and FIG. 3, and therefore, the description thereof will be omitted. The lower heating section 50*a* and the upper heating section 50*b* of the heating units 50A and 50B may be moved up and down together or in synchronization with each other. The rotating units 40 respectively provided in the heating unit 50A and the heating unit 50B may also be moved up and down in synchronization with each other. Note that, however, it is preferred that powering on/off of the rotating unit 40, the rotation speed and the rotation direction are independently controllable.

By preheating the treatment container 10B by the heating unit 50A while the treatment space 24 is vacuum-evacuated, moisture adsorbed on the magnet pieces 1 and other materials in the treatment container 10B is removed. The heating temperature is preferably not less than about 200° C. and not more than about 600° C. If it is less than about 200° C., the moisture cannot be sufficiently removed and/or a long time is required to remove the moisture. If it is more than about 600° C., there is a probability that the treatment container 10 deforms. Therefore, it is necessary to rotate the treatment container 10B by the rotating unit 40. In other words, so long as the temperature is kept not more than about 600° C., it is advantageously not necessary to activate the rotating unit 40.

The treatment container 10B arriving from stage A is at the room temperature. Therefore, the time required to heat the treatment container 10B to about 600° C., including the heating-up time, is long. In view of such, the heating unit 50A is set in the closed state in advance, so that the treatment container 10B is heated to about 300° C. At the timing of arrival of the treatment container 10B from stage A, the heating unit 50A is set in the opened state so as to receive the treatment container 10B. Then, the heating unit 50A is set in the closed state again. The temperature is raised to a target temperature, e.g., about 600° C., in about 1 hour and then kept at about 600° C. for about 2 hours.

At the final step of stage B, vacuum-evacuation of the treatment container 10B is stopped, and the gas inside the treatment container 10B is purged with argon (Ar) gas. For example, the treatment container 10B is charged with Ar gas of 100 kPa at about 600° C., such that 135 kPa is reached at about 900° C. Instead of purging with Ar gas (negative pressure), the treatment container 10B may be hermetically sealed in a reduced-pressure state (e.g., not more than 1 Pa).

Stage C (S-C) is a stage for performing a heat treatment such that a desired element is diffused into the magnet pieces (e.g., heating to a temperature of not less than about 450° C. and not more than about 1000° C.). If the treatment temperature exceeds about 1000° C., there is a probability that the magnet pieces 1 cause grain growth so that the magnetic properties greatly deteriorate. On the other hand, if the treatment temperature is less than about 450° C., a long time is required for the treatment. To complete the diffusion treatment in about 3 hours, the heat treatment temperature is preferably not less than about 900° C. From the viewpoint of the thermal tolerance (lifetime) of the heating unit 50B, the heat treatment temperature is preferably not more than about 980° C.

The heating unit 50B is also heated to, for example, about 600° C. in advance before receiving the treatment container 10C. After the treatment container 10C is conveyed by the conveyor 30 from the heating unit 50A to the position of the heating unit 50B, the heating unit 50B is set in the closed state, and the rotating unit 40 is raised to rotate the treatment container 10C at, for example, 0.5 rpm. The temperature of the treatment container 10C is raised to about 900° C. in about 1 hour and kept at about 900° C. for about 2 hours. Thereafter, the heating is stopped, and the treatment container 10C is conveyed to subsequent stage D (S-D).

The time required for conveyance of the treatment container 10 between stages (e.g., the time required to set the heating unit 50A in the opened state, convey the treatment container 10, and set the heating unit 50B in the closed state) is preferably within 3 minutes. For example, the time required to set each of the heating units 50A and 50B in the opened state or the closed state is about 50 seconds, and the time required to convey the treatment container 10 in the x-axis direction is about 40 seconds (about 2 minutes and 20 seconds in total). If the time required for conveyance between stages is within 3 minutes, the temperature decrease resulting from conveyance from stage B to stage C can be suppressed to about several tens of Celsius degrees.

The heating units 50A and 50B are located on a second chassis 94. The second chassis 94 includes a supporting mechanism which is capable of adjusting the heating units 50A and 50B so as to be horizontal.

Subsequent stage D (S-D) is a stage for cooling the treatment container 10. In stage D, air cooling and water cooling may be performed. The cooling unit 70 described in this section is capable of both air cooling and water cooling.

The cooling unit 70 includes a lower cooling section 70*a* provided under the treatment container 10D and an upper cooling section 70*b* provided above the treatment container 10D. At least one of the lower cooling section 70*a* and the upper cooling section 70*b* is movable in the z-axis direction. The lower cooling section 70*a* and the upper cooling section 70*b* can be arranged so as to surround at least a central part of the treatment container 10D. It is preferred that the lower cooling section 70*a* and the upper cooling section 70*b* are each movable in the z-axis direction for the same reasons as those previously set forth regarding the movability of the lower heating section and the upper heating section in the z-axis direction.

The lower cooling section 70*a* and the upper cooling section 70*b* respectively include spray nozzles 76 and hoods 74*a*, 74*b*. As shown in FIG. 4, when the cooling unit 70 is in the closed state, the lower cooling section 70*a* and the upper cooling section 70*b* are arranged so as to surround at least a central part of the treatment container 10D. In this case, it is preferred that the part of the treatment container 10D surrounded by the cooling unit 70 preferably includes the entirety of the treatment space 24, part of the first heat insulator 26*a* and part of the second heat insulator 26*b*. When the cooling unit 70 is in the closed state, the diameter of the circle formed by the hood 74*a* and the hood 74*b* is smaller than the diameter of the lid 14*a* (14*b*) of the treatment container 10D (e.g., 450 mm) and slightly larger than the outside diameter of the main body 12 of the treatment container 10D (e.g., 320 mm). For example, the clearance is 5 mm. By thus surrounding the treatment container 10D with the hoods 74*a*, 74*b* of the cooling unit 70, the temperature inside the treatment space 24 of the treatment container 10D can be decreased uniformly and efficiently. Note that, preferably, a thermocouple (not shown) is provided at a position near the treatment container 10D inside the space surrounded by the hood 74*a* and/or the hood 74*b* for monitoring the temperature.

The lower cooling section 70*a* has an air inlet 72 for air cooling. The upper cooling section 70*b* has an exhaust port 74. The arrangement of the air inlet 72 and the exhaust port 74 is not limited to this example. It is only necessary that either one of the lower cooling section 70*a* or the upper cooling section 70*b* has such components. The air for air cooling is supplied from, for example, a fan 82. The upper cooling section 70*b* has the spray nozzles 76 for water cooling. For example, when the temperature of the treatment container 10D is decreased by air cooling to about 300° C., the operation is switched from air cooling to water cooling. When the temperature of the treatment container 10D is lower than about 600° C., the pressure inside the treatment container 10D is lower than the atmospheric pressure. In this condition, environmental air (including moisture) is likely to enter the treatment container 10D. Therefore, using the treatment container 10D which has sufficient hermeticity is preferred.

Preferably, the treatment container 10D is rotated till the temperature of the treatment container 10D decreases to about 600° C. Therefore, as shown in FIG. 4, it is preferred that the cooling unit 70 also includes a rotating unit 40.

In the above description, description of the mechanism of switching the opened state/the closed state of the heating unit 50 and the cooling unit 70 and description of the mechanism of moving up and down the cooling unit 70 are omitted. These mechanisms are realized by known mechanisms. Examples of these mechanisms include a known lift which includes a hydraulic cylinder or the like.

The components of the diffusion treatment device 100, such as the conveyor 30, the rotating unit 40, the heating units 50A, 50B, the cooling unit 70, the fan 82, etc., can be manually operated. However, some or all of these components can be automatically controlled by computer programs.

The diffusion treatment device 100 may further include a first controller for outputting a signal for controlling, for example, at least one of movement of the treatment container 10 in the x-axis direction, movement of the lower heating section 50*a* and the upper heating section 50*b* in the z-axis direction, and rotation of the first rotating unit 40. Since the operation timings of these components are associated with one another, it is preferred that the first controller controls all of these components.

The diffusion treatment device 100 may further include a second controller for outputting a signal for controlling the heating units 50A, 50B. The second controller controls, for example, the temperature of the heating units 50A, 50B. The second controller may further output signals for controlling movement of the upper and lower heating sections 50*a*, 50*b* and opening/closing of the lids of the heating units 50A, 50B.

Likewise for the cooling unit 70, the diffusion treatment device 100 may further include a third controller for outputting a signal for controlling at least one of movement of the treatment container 10 in the x-axis direction, movement of the lower cooling section 70*a* and the upper cooling section 70*b* in the z-axis direction, and rotation of a second rotating unit 40. The diffusion treatment device 100 may further include a fourth controller for outputting a signal for controlling the cooling unit 70. The fourth controller controls, for example, switching between air cooling and water cooling in the cooling unit 70. The fourth controller may further output a signal for controlling movement of the upper and lower cooling sections 70*a*, 70*b*.

Since in the diffusion treatment device 100 a plurality of components operate in association with one another, for example, the first controller and the second controller may be integrated together and/or the second controller and the third controller may be integrated together. Further, all of the first to fourth controllers may be integrated together. In the diffusion treatment device 100 described in the above example, a single conveyor 30 realizes conveyance from stage A to stage D, although each conveyance between two stages can be realized by different conveyors 30. In such a case, a controller may be provided for each conveyor. On the other hand, when a plurality of components are aligned in the x-axis direction as in the diffusion treatment device 100, a single conveyor 30 can advantageously realize conveyance from stage A to stage D.

When the diffusion treatment device 100 is used, formation of chips in sintered magnet pieces is reduced and a diffusion treatment can be performed with high mass production efficiency as compared with conventional manufacturing devices. For example, when a diffusion treatment was performed on a magnet piece shown in FIG. 6(*a*) (30 mm in length×10 mm in width×5 mm in thickness) using the diffusion treatment device 100, chips were rarely formed, and the yield was not less than 99%. Note that, in calculation of the yield of the magnet piece 1, when a defective portion formed by chipping was substantially equal to or greater than a square of 2 mm on each side, that portion was counted as formation of a chip.

A diffusion treatment device of an embodiment of the present invention is not limited to the previously-described exemplary diffusion treatment device 100 but can be variously modified.

A diffusion treatment device of an embodiment of the present invention only needs to have the above-described stages A to D. For example, stage B and stage C may be the same stage, i.e., may be realized by the same heating unit 50. Therefore, as for conveyance of the treatment container 10 between the stages, the diffusion treatment device only needs to include at least a conveyor which is capable of conveying the treatment container 10 in the x-axis direction relative to the heating unit 50.

As a matter of course, in consideration of mass productivity, a plurality of identical stages may be provided. For example, two stages C may be provided such that the time required for stage C is twice the time required for stage B. In this case, pitched conveyance is carried out by the conveyor 30 with predetermined time intervals. Alternatively, a plurality of treatment containers 10 may be treated in each stage.

The arrangement of the stages does not need to be a single-row arrangement such as illustrated in the example. Some or all of the stages in the stage configuration may be arranged in a plurality of rows. Alternatively, the arrangement of the stages may be a vertical arrangement.

After stage C, a stage for an additional heat treatment may be added. The additional heat treatment may be performed when necessary, for the purpose of diffusing the previously-diffused elements uniformly into an inner part of the magnet pieces. The stage for the additional heat treatment may be provided after stage C or may be provided independently of the other stages. When the stage for the additional heat treatment is provided independently, it is not necessary to convey the treatment container 10 in a pitched manner. Therefore, a plurality of treatment containers 10 can be treated together using, for example, an electric furnace or the like.

A diffusion treatment device of an embodiment of the present invention can have various stage configurations. When a diffusion treatment device of an embodiment of the present invention is used, formation of chips in the magnet pieces 1 is suppressed and a diffusion treatment can be carried out with high yield as compared with conventional devices. To efficiently suppress formation of chips, the inside diameter of the treatment container is preferably not more than about 500 mm.

INDUSTRIAL APPLICABILITY

The present invention is suitably applicable to manufacture of a R-T-B sintered magnet of high residual magnetic flux density and high coercivity. Such a magnet is suitable to various motors, including motors incorporated in hybrid vehicles which are to be exposed to high temperatures, and to home electronics.

REFERENCE SIGNS LIST

10 treatment container
12 main body
14*a* first lid
14*b* second lid
24 treatment space
26*a*, 26*b* heat insulator
30 conveyor
40 rotating unit

The invention claimed is:

1. A diffusion treatment device, comprising:

a treatment container including a cylindrical main body and a first lid and a second lid, the cylindrical main body having a treatment space which is capable of receiving a plurality of R-T-B sintered magnet pieces and diffusion sources, the first lid and the second lid being capable of hermetically sealing a first opening and a second opening, respectively, at opposite ends of the cylindrical main body;

a conveyor for conveying the treatment container by a predetermined distance in an x-axis direction while a longitudinal direction of the treatment container is located in a y-axis direction in a rectangular coordinate system xyz where a z-axis direction is a vertical direction;

a heating unit including a lower heating section provided under the treatment container and an upper heating section provided above the treatment container, at least one of the lower heating section and the upper heating section being movable in the z-axis direction and being arrangeable so as to surround at least a central part of the treatment container, a first rotating unit for rotating the treatment container around a y-axis while the longitudinal direction of the treatment container is located in the y-axis direction and the treatment container is surrounded by the lower heating section and the upper heating section, and a cooling unit subsequent to the heating unit, wherein the cooling unit includes a lower cooling section provided under the treatment container and an upper cooling section provided above the treatment container, at least one of the lower cooling section and the upper cooling section being movable in the z-axis direction and being arrangeable so as to surround at least a central part of the treatment container.

2. The diffusion treatment device of claim 1, wherein the lower heating section and the upper heating section are each movable in the z-axis direction.

3. The diffusion treatment device of claim 1, wherein the treatment container further includes a first flange and a second flange at opposite ends in the longitudinal direction, and when the first lid is secured to the first flange and the second lid is secured to the second flange, the first opening and the second opening are respectively hermetically sealed.

4. The diffusion treatment device of claim 3, wherein the first rotating unit includes a first wheel pair which is in contact with at least one of the first flange and the first lid and a second wheel pair which is in contact with at least one of the second flange and the second lid, and the first wheel pair and the second wheel pair are each arranged along the x-axis direction and each include two wheels rotatable around the y-axis.

5. The diffusion treatment device of claim 4, wherein the treatment container is detached from the conveyor while the first wheel pair and the second wheel pair support the treatment container.

6. The diffusion treatment device of claim 4, wherein the two wheels of each of the first wheel pair and the second wheel pair have a variable rotation speed and/or are reversely rotatable.

7. The diffusion treatment device of claim 1, further comprising a connecting portion connected with either of the first lid or the second lid.

8. The diffusion treatment device of claim 7, further comprising a safety valve connected with the other of the first lid or the second lid.

9. The diffusion treatment device of claim 1, further comprising a first controller for outputting a signal for controlling at least one of movement of the treatment container in the x-axis direction, movement of the lower heating section and the upper heating section in the z-axis direction, and rotation of the first rotating unit.

10. The diffusion treatment device of claim 9, further comprising a second controller for outputting a signal for controlling the heating unit.

11. The diffusion treatment device of claim 1, wherein the lower cooling section and the upper cooling section are each movable in the z-axis direction.

12. The diffusion treatment device of claim 1, further comprising a second rotating unit for rotating the treatment container around the y-axis while the longitudinal direction of the treatment container is located in the y-axis direction and the treatment container is surrounded by the lower cooling section and the upper cooling section.

13. The diffusion treatment device of claim 1, wherein at least one of the lower cooling section and the upper cooling section includes at least one of an air inlet and a spray nozzle for water.

14. The diffusion treatment device of claim 1, further comprising a third controller for outputting a signal for controlling at least one of movement of the treatment container in the x-axis direction, movement of the lower cooling section and the upper cooling section in the z-axis direction, and rotation of the second rotating unit.

15. The diffusion treatment device of claim 14, further comprising a fourth controller for outputting a signal for controlling the cooling unit.

16. A method for manufacturing an R-T-B sintered magnet, comprising:

(a) providing an R-T-B sintered magnet piece in which an amount of R, which is defined by a content of a rare earth element, is not less than 29 mass % and not more than 40 mass %;

(b) providing diffusion sources;

(c) loading at least the sintered magnet piece and the diffusion sources into the treatment space of the diffusion treatment device as set forth in of claim 1;

(d) preheating at a temperature of not less than about 200° C. and not more than about 600° C. while vacuum-evacuating the treatment space;

(e) after the preheating, hermetically sealing the treatment space while the treatment space is in a reduced-pressure state or contains an inert gas; and (f) a diffusion step including, after (e), heating the treatment container to a treatment temperature of not less than about 450° C. and not more than about 1000° C.

17. The method of claim 16, wherein the diffusion sources are RH diffusion sources including at least one of Dy and Tb.

18. The method of claim 16, wherein the diffusion sources are RH diffusion sources including at least one of Dy and Tb and are powder including particles of not more than 90 μm in size.

19. The method of claim 16, wherein the RH diffusion sources include a heavy rare earth element RH (at least one of Dy and Tb) and Fe in the proportion of not less than 30 mass % and not more than 80 mass %.

* * * * *